US005542125A

United States Patent [19]

Zuckerwar

[11] Patent Number: 5,542,125

[45] Date of Patent: Aug. 6, 1996

[54] GLOVES WITH INTERCHANGEABLE FINGER AND MITTEN CAPS

[75] Inventor: Richard J. Zuckerwar, Gloversville, N.Y.

[73] Assignee: The Grandoe Corp., Gloversville, N.Y.

[21] Appl. No.: 300,042

[22] Filed: Sep. 2, 1994

[51] Int. Cl.[6] ..... A41D 13/10; A41D 19/01

[52] U.S. Cl. ..... 2/158; 2/160

[58] Field of Search ..... 2/161.2, 159, 161.1, 2/161.5, 164, 163, 16, 19, 165, 166, 275, 158, 160, 161.6, 169, 917; D2/610, 611, 612, 613, 614, 615, 616, 617, 618, 619, 620, 621, 622, 623

[56] References Cited

U.S. PATENT DOCUMENTS

| | | | |
|---|---|---|---|
| 1,113,870 | 10/1914 | Billings | 2/161.1 |
| 1,934,332 | 11/1933 | Skinner | 2/162 |
| 2,274,510 | 2/1942 | Wohl et al. | D2/614 X |
| 2,318,785 | 5/1943 | Kopplin | 2/158 |
| 2,451,837 | 10/1948 | La Londe et al. | 2/158 |
| 3,064,266 | 11/1962 | Veghte, Jr. | 2/158 |
| 4,104,740 | 8/1978 | Rinehart | 2/158 |
| 4,195,405 | 4/1980 | Monk | 2/158 |
| 4,359,784 | 11/1982 | Harrington | 2/269 |
| 4,670,909 | 6/1987 | Forrester | 2/160 |
| 4,704,743 | 11/1987 | Thornell et al. | 2/159 |

FOREIGN PATENT DOCUMENTS

| | | | |
|---|---|---|---|
| 1188453 | 6/1985 | Canada | 2/159 |
| 146250 | 11/1902 | Germany | 2/159 |
| 219910 | 9/1942 | Switzerland | 2/158 |

*Primary Examiner*—C. D. Crowder
*Assistant Examiner*—Shirra L. Jenkins
*Attorney, Agent, or Firm*—Lieberman & Nowak

[57] ABSTRACT

A glove which includes a body portion and interchangeable mitten and finger caps. The body portion, the mitten cap portion and the finger cap portion are provided with a sealing fastener which allows the body portion to be fitted with either the mitten cap or the finger cap based on the weather conditions and the user's need or desire for manual dexterity.

5 Claims, 2 Drawing Sheets

GLOVES WITH INTERCHANGEABLE FINGER AND MITTEN CAPS

FIELD OF THE INVENTION

This invention relates to gloves and more particularly to gloves used for winter activities which require manual dexterity, such as skiing, hunting or working outdoors.

BACKGROUND OF THE INVENTION

Participants in winter activities which require a certain amount of manual dexterity have had to make sacrifices in choosing between mittens for warmth and gloves with individual fingers which provide freedom of movement. Conventional mittens provide more protection against cold than a glove having individual fingers. The grouping of the fingers within the cap of a mitten provides an increase in comfort and warmth to the user.

However, one relying on mittens for warmth sacrifices the manual dexterity provided by the individual fingers of a glove. Mittens lack the feel imparted by a fingered glove and the bulk of the cap of the mitten may inhibit the grasping of items such as ski poles, rifles or tools.

Limiting one's choice to fingered gloves is also not always acceptable since some activities require long periods of exposure to extremely cold temperatures.

There is a need to provide hand insulation which provides both the warmth of mittens and the manual dexterity provided by gloves. Gloves which attempt to solve this problem are known to the art.

For example, U.S. Pat. No. 4,704,743 to Thornell et al., which issued Nov. 10, 1987, discloses a ski glove which has removable thumb and index portions to completely expose the thumb and index fingers for added movement. Similarly, U.S. Pat. No. 2,318,785 to Kopplin, which issued May 11, 1943, and U.S. Pat. No. 2,451,837 to La Londe et al., which issued Oct. 19, 1948, disclose mittens with slots which allow the temporary exposure of the digits to allow dexterity for short periods. These patented articles fail to solve the problem of providing the warmth of a mitten while permitting the long term dexterity of a fingered glove. In order to provide the necessary manual dexterity, the articles require completely exposing the user's digits to the elements, thus limiting the time the user can enjoy the benefits of manual dexterity.

U.S. Pat. No. 3,064,266 to Veght, Jr., which issued on Nov. 20, 1962 and U.S. Pat. No. 1,113,870 to Billings, which issued Oct. 13, 1914, both disclose gloves which have a mitten cap either applied over or wrapped around the fingers of a glove. This combination results in a hand covering which consists of both individual fingers and a mitten cap. This attempt to solve the above described problem results in a glove/mitten combination which allows less manual dexterity than the poor manual dexterity offered by a mitten alone, while not providing the full warmth benefits of a mitten. Further, the design of these gloves require that the mitten cap be affixed to the body of the glove when not in use, further inhibiting the manual dexterity of the user and resulting in a bulky and uncomfortable glove.

Other patents which attempt to provide gloves or products for use in winter activities include U.S. Pat. No. 4,104,740 to Rinehart (Aug. 8, 1978) which describes a mitten/glove product with specific flexing points; U.S. Pat. No. 4,195,405 to Monk (Apr. 1, 1980) which describes a knitted glove that allows a knitted material to be pulled up over the finger and thumb sections to create additional protection; U.S. Pat. No. 4,359,784 to Harrington (Nov. 23, 1982) which describes a coat cuff extension to provide coverage of the hand; and U.S. Pat. No. 1,934,332 to Skinner, which describes a washable gauntlet. These patents do not solve the above described problem nor do they relate to the design or strategy of the invention of the present application.

SUMMARY OF THE INVENTION

According to the instant invention a glove is provided which includes a body portion and interchangeable mitten and finger caps. The body portion, the mitten cap portion and the finger cap portion are all provided with a sealing fastener which allows the body portion to be fitted with either the mitten cap or the finger cap based on the weather conditions and the user's need or desire for manual dexterity.

An object of the present invention is to provide a glove which has interchangeable finger and mitten caps to allow the user to easily choose hand protection in cold or otherwise inclement weather that provides the benefits of either a mitten or a glove with individual fingers.

Another object of the present invention is to provide practical hand protection to a participant in outdoor winter activities, such as skiing, hunting or working, which require both manual dexterity and long term exposure to inclement weather.

Another object of the present invention is to provide hand protection in the form of a mitten for use during long term exposure to cold weather.

A further object of the present invention is to provide hand protection in the form of a glove with individual fingers for use when manual dexterity is required.

A further object of the present invention is to provide hand protection with which the user can easily switch between the mitten mode and the glove mode.

Another object of the present invention is to provide a method of storage of either of the mitten or finger caps which are not being used.

The invention will be better understood by reference to the following detailed description taken in conjunction with the accompanying drawings.

DETAILED DESCRIPTION OF THE PREFERRED EMBODIMENTS

While the invention will be described in connection with a preferred embodiment, it will be understood that it is not intended to limit the invention to the described embodiment. On the contrary, it is intended to cover all alternatives, modifications and equivalents as may be included within the spirit and scope of the invention as defined by the appended claims.

Figure 1:
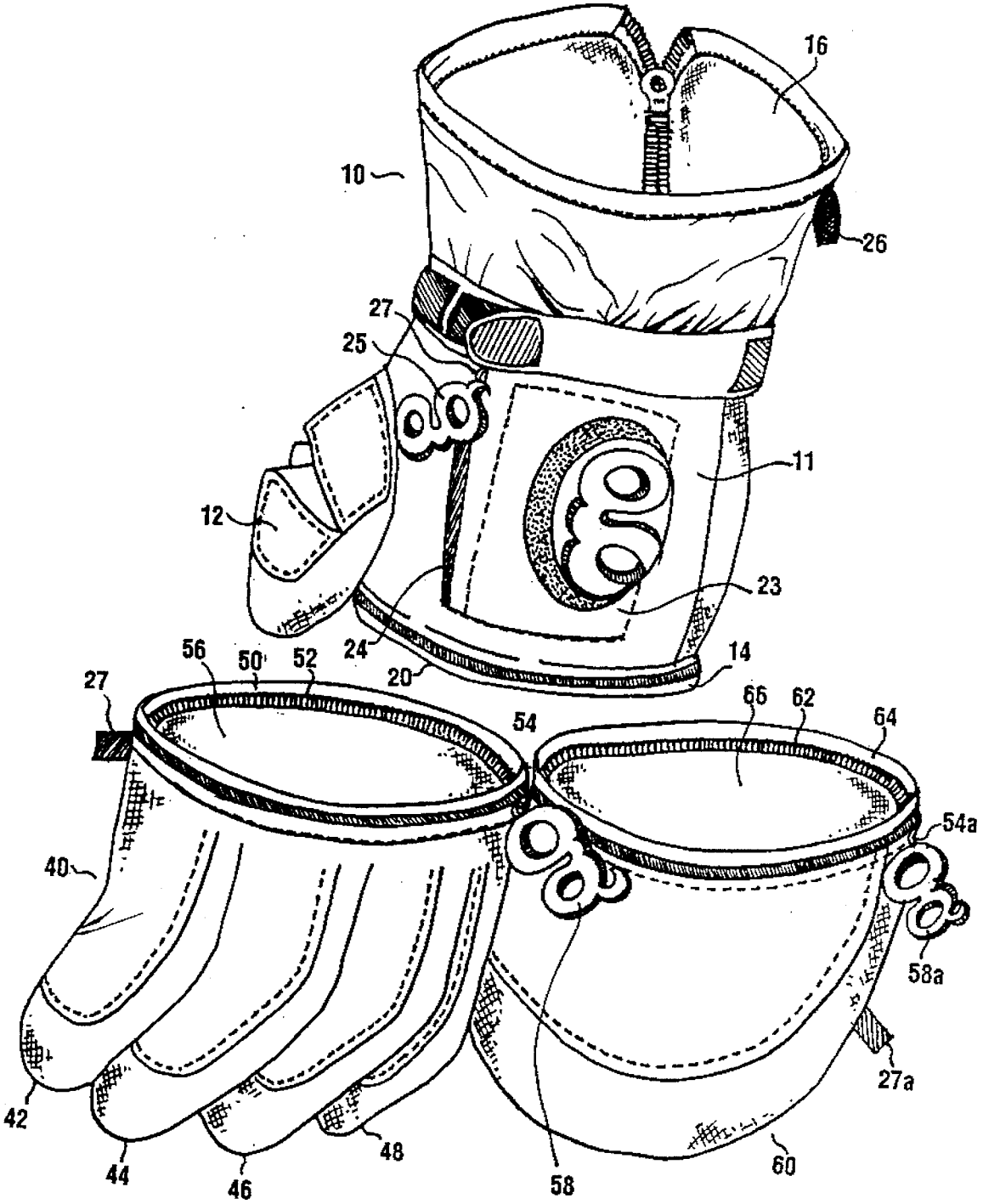
FIG. 1 is a view of a glove in accordance with the invention, showing the body portion and the interchangeable mitten and finger caps.

FIG. 1 illustrates a preferred embodiment of the present invention. The glove of the present invention includes a body portion 10, a finger cap 40 and a mitten cap 60, the caps being interchangeably and removeably attached to the body portion 10.

The body portion 10, the finger cap 40 and the mitten cap 60, are all constructed of a material suitable to insulate the hand against cold and wet weather. Such material is preferably insulated and waterproof and could be nylon, leather or one or more of many other suitable materials well known to the art.

Figure 2:
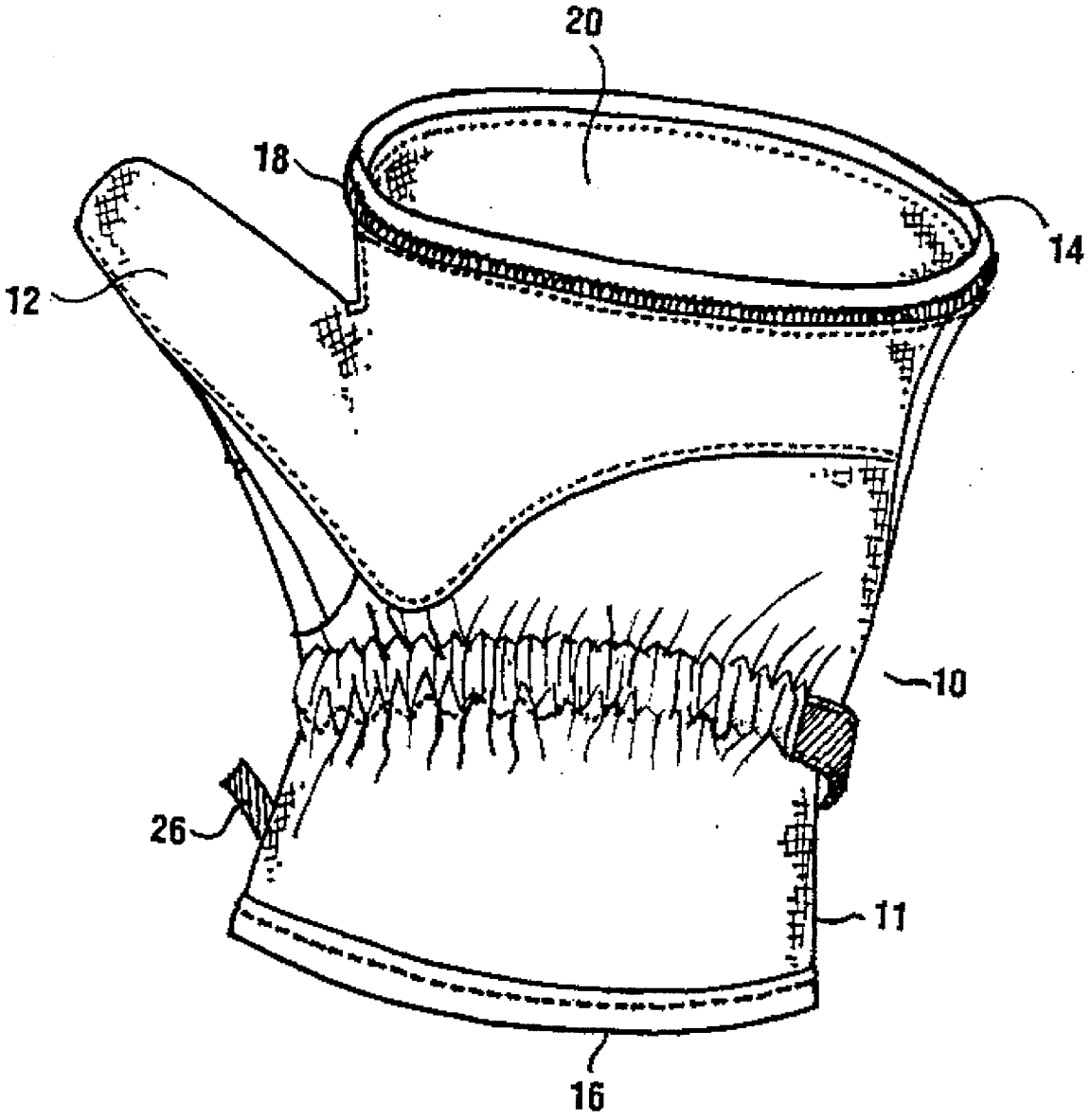
FIG. 2 is a reverse view of the body portion of the inventive glove showing the palm side and the interior distal portion of the body portion.

Referring to both FIGS. 1 and 2, the body portion 10 includes a sheath portion 11 for covering the wrist, palm and back portions of the user's hand. The body portion 10 also has a thumb portion 12.

The proximal end of the body portion 10 comprises an opening 16 to enable the user to place his hand in the inventive glove.

The distal end of the body portion 10 includes an opening 20, through which the user's fingers will fit. The distal end of the body portion 10 also includes a sealing fastener 18, preferably in the form of a zipper 18, which encircles the entire interior circumference of opening 20 of the body portion 10.

The zipper 18 is preferably corrosion resistant, such as a commercially available elastomeric zipper. The sealing fastener 18 may also be a hook-and-loop fastener or some other suitable device. The finger cap 40 and mitten cap 60 comprise a mating sealing fastener 52 and 62 on their respective proximal portions for removeably attaching the respective caps to the body portion 10.

The preferred placement of the zipper 18 is on the inside of an overlap 14 located at the distal end of the sheath portion 11. The zipper 18 is placed on the overlap 14 such that a portion of overlap 14 extends distally past the zipper 18. This portion of the overlap 14 covers the zipper 18 and protects the user's hand from rain or snow leakage. The finger cap 40 and mitten cap 60 further comprise a mating overlap 50 and 64 respectively to work with overlap 14 to cover and protect the zipper 18 from water and snow and ensure that no water or snow leak into the glove.

The glove of the present invention can be used in two modes: (i) when manual dexterity is required, the finger cap 40 is attached to the body portion 10 to constitute a glove with individual fingers, or (ii) when protection from cold is desired, the mitten cap 60 is attached to the body portion 10 to constitute a mitten.

Referring now to FIG. 1, the finger cap 40 includes finger portions 42, 44, 46 and 48 which act to cover and protect the user's individual fingers. The finger cap 40 further comprises an opening 56 at its proximal end through which the user's fingers are slid into the finger portions 42, 44, 46 and 48.

As stated above, the finger cap 40 also includes a mating sealing fastener 52, preferably in the form of a mating zipper 52, which acts to mate with zipper 18 on the body portion 10 to interchangeably and removeably attach the finger cap 40 to the body portion 10. Preferably the mating zipper 52 follows the entire inner circumference of the opening 56 of the finger cap 40.

Preferably the mating zipper 52 is located on the inside of an overlap 50 at the proximal end of the finger cap 40 with a portion of the overlap 50 extending proximally beyond the mating zipper 52. This portion of the overlap 50 works with the overlap 14 to seal the connection between the body portion 10 and the finger cap 40 from water and snow.

A fob 58 is attached to the zipper 52 at connection point 54 whereby the user can easily open and close the mating zipper parts 18 and 52. The fob 58 is preferably of a size large enough where it can be easily grasped by the user's other gloved hand.

A mitten cap 60 is also provided for use when the user desires protection from cold weather and does not need a great deal of manual dexterity. The mitten cap 60 has an opening 66 at its proximal end to allow the user to slip his fingers into the mitten cap 60.

As describe in relation to the finger cap 40, the mitten cap also includes a mating sealing fastener 62, preferably in the form of a mating zipper 62, which acts to mate with zipper 18 on the body portion 10 to interchangeably and removeably attach the mitten cap 60 to the body portion 10. Preferably the mating zipper 62 follows the entire inner circumference of the opening 66 of the mitten cap 60.

Preferably the mating zipper 62 is located on the inside of an overlap 64 at the proximal end of the mitten cap 60 with a portion of the overlap 64 extending proximally beyond the mating zipper 62. This portion of the overlap 64 works with the overlap 14 to seal the connection between the body portion 10 and the mitten cap 60 from water and snow.

As described with relation to the finger cap 40, the mitten cap 60 further comprises a fob **58*a* which is attached to the zipper 62 at connection point 54*a* whereby the user can easily open and close the mating zipper parts 18 and 62**.

In order to store the cap that is not being used, a number of options are provided to the user. The simplest option is to merely store the unused cap in the user's pocket or other suitable storage place.

Preferably the body portion 10 is provided with an attachment point 26 for attaching the unused cap, each of said caps are provided with a mating attachment point 27 and **27*a*. The attachment point 26 could be a hook-and-loop type of material with a matching hook-and-loop material 27** provided on the caps or some other suitable attachment mechanism.

Alternatively, the body portion 10 is provided with a pocket 23 large enough to hold the unused cap. Preferably the pocket 23 is provided with a sealing fastener 24, preferably in the form of a zipper 24, to open and close the pocket 23. The zipper 24 is provided with a fob 25 connected at attachment point 27 to enable the user to easily open and close the zipper 24.

It will be apparent to one skilled in the art that various modifications and equivalents may be employed in practicing this invention. No limitations are to be inferred or implied except as set forth in the claims.

I claim:

1. A glove having interchangeable finger and mitten caps comprising:

a body portion, said body portion being configured to receive the thumb, palm and back of the hand of a wearer, a circumferential opening disposed in the body portion at the base of the wearers fingers, first attachment means disposed along the entire periphery of the circumferential opening;

a finger cap, said finger cap having individual pockets for each of the wearers fingers other than the thumb, a circumferential opening located at the base of the fingers configured to conform to the circumferential opening of the body portion and second attachment means disposed around the entire periphery of the circumferential opening for releasible engagement with the attachment means of the body;

a mitten cap, said mitten cap having a single pocket for the wearer's fingers other than the thumb, a circumferential opening located at the base of the single pocket configured to conform to the circumferential opening of the body portion and third attachment means disposed around the entire periphery of the circumferential opening for releasible engagement with the attachment means of the body;

said first, second and third attachment means permitting the alternative attachment of said body portion to one of said finger cap and said mitten cap; and means, disposed proximal to the attachment means on at least one of said body portion, said finger cap and said mitten cap, for overlapping the corresponding attachment means to cover said attachment means.

2. The glove according to claim 1 wherein said attachment means comprises a zipper.

3. The glove according to claim 1 wherein said glove further comprises a storage means for storing either of said finger cap or said mitten cap which is not attached to said body portion.

4. The glove as claimed in claim 1 wherein said overlapping means are disposed on said body portion and said finger and mitten caps, such that the overlapping means disposed on the body portion is located on the exterior of the glove with the overlapping means on the finger and mitten caps being located at the interior of the glove.

5. The glove as claimed in claim 1 wherein said attachment means comprise hook and loop fasteners.

* * * * *